US008942962B2

(12) United States Patent
Osogami et al.

(10) Patent No.: US 8,942,962 B2
(45) Date of Patent: Jan. 27, 2015

(54) METHOD AND SYSTEM FOR MEASURED VALUE SIMULATION

(75) Inventors: Takayuki Osogami, Kanagawa (JP); Shoko Suzuki, Kanagawa (JP)

(73) Assignee: International Business Machines Corporation, Armonk, NY (US)

( * ) Notice: Subject to any disclaimer, the term of this patent is extended or adjusted under 35 U.S.C. 154(b) by 682 days.

(21) Appl. No.: 13/101,281

(22) Filed: May 5, 2011

(65) Prior Publication Data

US 2011/0288833 A1 Nov. 24, 2011

(30) Foreign Application Priority Data

May 19, 2010 (JP) ..... 2010-115169

(51) Int. Cl.
*G06G 7/76* (2006.01)
*G08G 1/01* (2006.01)

(52) U.S. Cl.
CPC ..... *G08G 1/0112* (2013.01)
USPC ..... 703/6; 703/2

(58) Field of Classification Search
None
See application file for complete search history.

(56) References Cited

FOREIGN PATENT DOCUMENTS

| | | | |
|---|---|---|---|
| JP | H09128677 | A | 5/1997 |
| JP | 2000-163451 | | 6/2000 |
| JP | 2000163451 | A | 6/2000 |
| JP | 2002-286860 | | 10/2002 |
| JP | 2004-118735 | | 4/2004 |
| JP | 2004118735 | A | 4/2004 |
| JP | 2009032043 | A | 2/2009 |
| JP | 2010501100 | A | 1/2010 |
| WO | 2008007471 | A1 | 1/2008 |

OTHER PUBLICATIONS

Sun et al. "Highway Traffic STate Estimation Using Improved Mixture Kalman Filters for Effect Ramp Metering Control", Dec. 2003, IEEE, Proceedings of the 42nd IEEE Conference on Decision and Control, pp. 6333-6338.*
Righter et al. "Distributed Simulation of Discrete Event Systems", Proceedings of the IEEE, vol. 77, No. 1, Jan. 1989, pp. 99-113.*
Zheng et al. "Short-Term Freeway Traffic Flow Prediction: Bayesian Combined Neural Network Approach", Feb. 2006, Jiournal of Transportation Engineering, pp. 114-121.*

* cited by examiner

*Primary Examiner* — S Lo
(74) *Attorney, Agent, or Firm* — Cantor Colburn LLP

(57) ABSTRACT

A method, system and computer program product for measured value simulation. The method including the steps of: observing measured values of an event to provide observed values, where the step of observing starts at a predetermined observation time; concurrently running a plurality of simulations, where the simulations have behaviors that are characterized by different parameters and start at the predetermined observation time; producing a discrete distribution at a predetermined timing after the predetermined observation time, where the discrete distribution are based on distances between the measured values provided by the predetermined timing and calculation of the simulations; and producing a second plurality of simulations based on the discrete distribution.

21 Claims, 7 Drawing Sheets

METHOD AND SYSTEM FOR MEASURED VALUE SIMULATION

CROSS-REFERENCE TO RELATED APPLICATION

This application claims priority under 35 U.S.C. §119 from Japanese Patent Application No. 2010-115169 filed May 19, 2010, the entire contents of which are incorporated herein by reference.

BACKGROUND OF THE INVENTION

1. Field of the Invention

The present invention relates to a computer-based simulation technique, and more particularly the present invention is related to a simulation technique adapted to a short-term prediction.

2. Description of the Related Art

In recent years, an intelligent transportation system as part of city planning has been actively studied particularly since the latter half of the '90s.

Recent particular needs include a real time road information processing technology, such as car flow adjustment, other road traffic control operation assistance, congestion prediction, and other information delivery to car navigation systems. Such road information processing is processed by, for example, a probe car data provided from a sensor attached to each operating car. Once probe car data becomes available, the next challenge is to use the probe car data to process traffic information in real time, such as the amount of traffic and the degree of road congestion.

Japanese Published Unexamined Patent Application No. 2000-163451 describes an environment prediction system including a computation apparatus that performs simulation calculation and an observation apparatus that collects observed data in predetermined positions within an area over which the simulation calculation is performed. In the system, the computation apparatus divides the simulation calculation area into a two-dimensional coordinate matrix, sets an initial value used in the simulation calculation at each coordinate, receives boundary conditions as input, and performs the simulation calculation based on the set initial values and the input boundary conditions to determine values of observation items at each coordinate after a predetermined period has elapsed. The observation apparatus collects observed data at predetermined coordinates after the predetermined period has elapsed, and the computation apparatus compares the values determined in the simulation calculation at the predetermined coordinates with the observed data provided from the observation apparatus. When the comparison shows any difference, the initial values and/or the boundary conditions are corrected, and the simulation calculation is performed again.

Japanese Published Unexamined Patent Application No. 2002-286860 describes a simulation apparatus that performs groundwater flow analysis in which groundwater flow is analyzed and substance movement analysis in which the movement of a substance in groundwater is analyzed by using a flow direction dispersion coefficient and a delay coefficient as substance transportation parameters along with a convection dispersion delay model under flow conditions obtained in the groundwater flow analysis. In the simulation apparatus, the flow direction dispersion coefficient aL represents dispersion of a target substance, which is an element in the convection dispersion delay model, in the groundwater with respect to the groundwater flow direction, and the delay coefficient Rd represents delay of the movement of the target substance in the groundwater with respect to the groundwater flow. The delay coefficient Rd is set to be a desired fixed value r0, and the flow direction dispersion coefficient aL is set to be a plurality of values. The simulation apparatus includes substance transportation analysis means and delay coefficient determination means. The substance transportation analysis means calculates a concentration distribution of the substance or the concentration of the substance at a specific point for each of the plurality of flow direction dispersion coefficients along an elapsed time axis. The delay coefficient determination means determines the flow direction dispersion coefficient by comparing the calculated results provided from the substance transportation analysis means with the substance concentration distribution measured at an analysis target location after an intended period m has elapsed as measured value information, selecting a calculation result most similar to the measured value information from the calculated results, and setting the flow direction dispersion coefficient used to acquire the selected calculation result as the flow direction dispersion coefficient. The delay coefficient determination means also determines the delay coefficient by using an elapsed period n corresponding to the selected calculation result and the elapsed period m in the measurement to calculate $r0 \times m/n$ and setting it as the delay coefficient.

Japanese Published Unexamined Patent Application No. 9-128677 discloses a technology in which the timing at which a traffic signal is changed is optimized by detecting a traveling vehicle having a built-in traveling path measuring device, monitoring traffic based on traveling path data provided from the traveling path measuring device, using actual traffic signal timing data and a vehicle traveling model to change the traveling path in the model to be close to the measured traveling path, and using the model to perform a simulation.

Japanese Published Unexamined Patent Application No. 2004-118735 discloses an apparatus that precisely predicts traffic over a period from the present to a relatively far future. The apparatus includes a traffic calculator that performs a traffic flow simulation based on road network data, traffic signal data over the road network, and the amount of OD traffic to calculate the amount of traffic, a future prediction processor that predicts the amount of future traffic based on the amount of observed past traffic and the amount of current observed traffic, and an OD traffic estimator that corrects the amount of OD traffic used in the traffic calculator in such a way that the amount of calculated traffic coincides with the amounts of current observed and predicted traffic.

The conventional technologies, however, only disclose methods for performing a simulation while correcting a simulator based on a measured observation data, but the methods do not particularly suggest improvement in simulator accuracy.

SUMMARY OF THE INVENTION

Accordingly, one aspect of the invention provides a method for performing simulations through computer processes, the method including the steps of: observing measured values of an event to provide observed values, where the step of observing starts at a predetermined observation time; concurrently running a plurality of simulations, where the simulations have behaviors that are characterized by different parameters and start at the predetermined observation time; producing a discrete distribution at a predetermined timing after the predetermined observation time, where the discrete distribution are based on distances between the measured values provided by the predetermined timing and calculation of the simulations; and producing a second plurality of simulations based on the discrete distribution.

Another aspect of the present invention provides a computer readable storage medium tangibly embodying a computer readable program code having computer readable instructions which when implemented, cause a computer to carry out the steps of: observing measured values of an event to provide observed values, where the step of observing starts at a predetermined observation time; concurrently running a plurality of simulations, where the simulations have behaviors that are characterized by different parameters and start at the predetermined observation time; producing a discrete distribution at a predetermined timing after the predetermined observation time, where the discrete distribution are based on distances between the measured values provided by the predetermined timing and calculation of the simulations; and producing a second plurality of simulations based on the discrete distribution.

Another aspect of the present invention provides a system for performing simulations through computer processes, the system including: an observing module for observing measured values of an event to provide observed values, where the step of observing starts at a predetermined observation time; a simulating module for concurrently running a plurality of simulations, where the simulations have behaviors that are characterized by different parameters and start at the predetermined observation time; a distributing module for producing a discrete distribution at a predetermined timing after the predetermined observation time, where the discrete distribution are based on distances between the measured values provided by the predetermined timing and calculation of the simulations; and a second simulating module for producing a second plurality of simulations based on the discrete distribution.

DETAILED DESCRIPTION OF THE DRAWINGS

Figure 1:
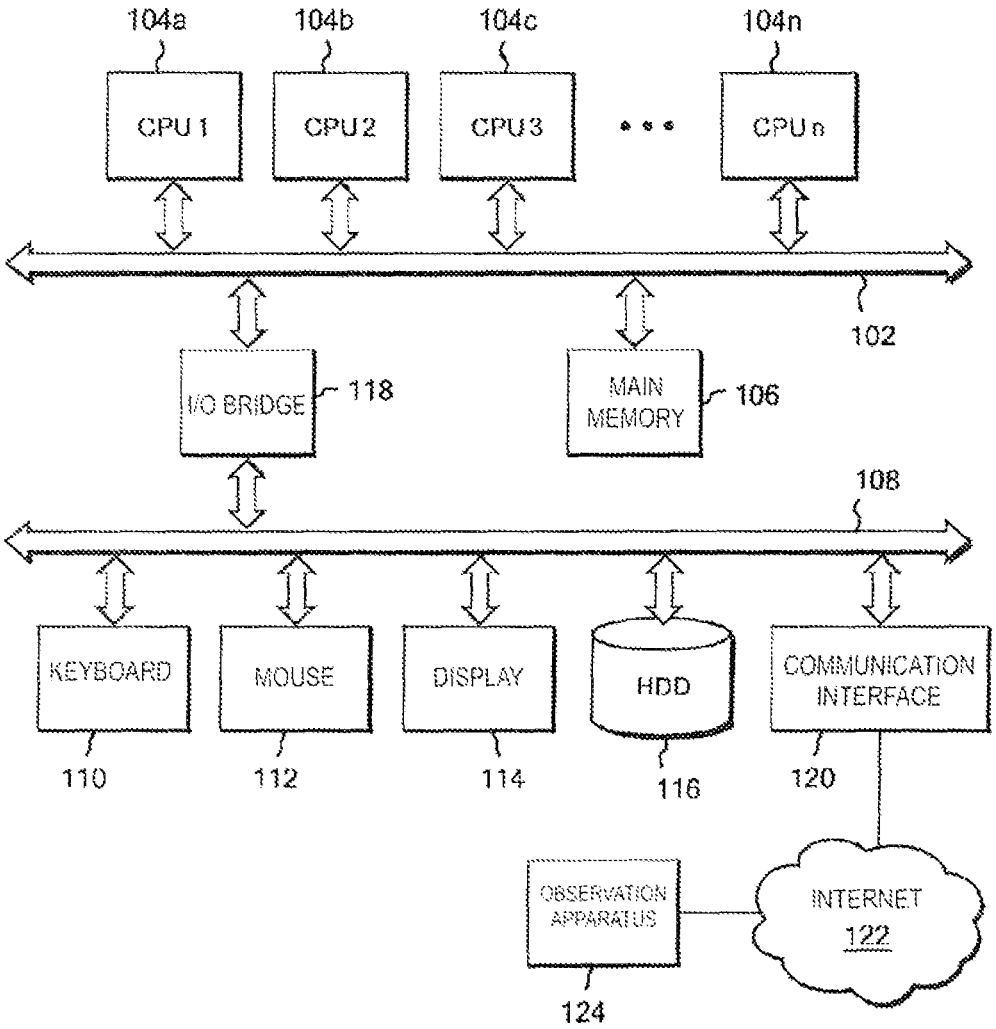
FIG. 1 shows a block diagram of exemplary hardware for performing a simulation.

The above and other features of the present invention will become more distinct by a detailed description of embodiments shown in combination with attached drawings. Identical reference numbers represent the same or similar parts in the attached drawings of the invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Computer hardware used to carry out the present invention will first be described referring to FIG. 1. In FIG. 1, a plurality of CPUs, a CPU1 104*a*, a CPU2 104*b*, a CPU3 104*c*, . . . a CPUn 104*n* are connected to a host bus 102. A main memory 106 is also connected to the host bus 102. Main memory 106 is used by the CPU1 104*a*, the CPU2 104*b*, the CPU3 104*c*, . . . CPUn 104*n* for computation.

On the other hand, a keyboard 110, a mouse 112, a display 114, and a hard disk drive 116 are connected to an I/O bus 108. I/O bus 108 is connected to the host bus 102 via an I/O bridge 118. An operator uses keyboard 110 and mouse 112 to input a command, click a menu, and perform other operation. Display 114 is used to display a menu for operating as required a program according to the present invention, which will be described later, via a GUI.

The IBM® System X is an example of the computer system hardware preferably used for the purpose described above. In System X, each of CPU1 104*a*, CPU2 104*b*, CPU3 104*c*, . . . CPUn 104*n* is, for example, Intel® Xeon®, and the operating system is, for example, Windows (TM) Server 2003, The operating system is stored in hard disk drive 116 and read therefrom to main memory 106 when the computer system is activated.

A multiprocessor system, although not necessarily essential to carry out the present invention, is desirably used. The reason for this is that a sufficient number of cores or processors allow each simulation thread to be allocated to a dedicated core or processor for high-speed operation. A multiprocessor system used herein refers, in general, to a system using a processor including a plurality of cores each of which functions as a processor that can independently perform computation. It should therefore be understood that any of a multi-core single-processor system, a single-core multiprocessor system, and a multi-core multiprocessor system can be used.

The computer system hardware that can be used to carry out the present invention is not limited to IBM® System X but can be any computer system on which a simulation program product according to the present invention can run, such as a typical personal computer. The operating system is also not limited to Windows® but can be any operating system, such as Linux® and Mac OS®. Further, to run a simulation program product at high speed, IBM® System P including POWER™ 6 and using the AIX™ operating system can, for example, be used.

Hard disk drive 116 further stores, for example, a simulator 204, a weight calculation module 206, a simulator selection module 208, and parameters 210 for performing a simulation according to the present invention, which will be described later with reference to FIG. 2. They are loaded to main memory 106 and executed in response to user's operation performed through the keyboard or the mouse.

A communication interface 120 connects an observation apparatus 124 to I/O bus 108 via Internet 122. Observation apparatus 124 in the present example is an apparatus that observes probe car data. The system shown in FIG. 1 can acquire data from the probe car data regularly or irregularly via communication interface 120. The probe car data can be replaced with fixed-point observation data. Communication interface 120 is, for example, an Ethernet card. In this case, although not shown, the Ethernet card is wired to the observation apparatus 124 via a specific web server. Communication interface 120 can alternatively be connected to a server through a dial-up connection via a data communication card or connected to a server over a public wireless LAN. In the present invention, it should be understood that the mode of connection of observation apparatus 124 is not limited to a specific form, but that any connection configuration can be used.

Figure 2:
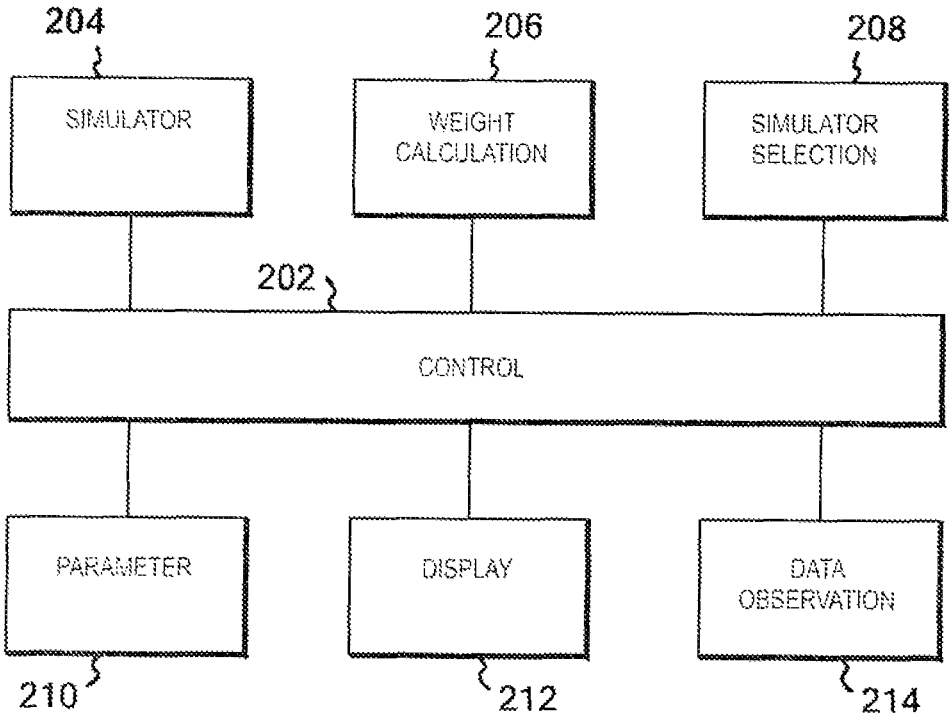
FIG. 2 shows an exemplary functional block diagram for performing a simulation.

In FIG. 2, a control module 202 is saved in hard disk drive 116. The operating system loads control module 202 to main memory 106, in response to user's operation performed through keyboard 110, mouse 112, or any other component and executes control module 202.

Control module 202 manages the overall behavior of a simulation and can be implemented as a management thread allocated to, but not limited to, one of the plurality of CPUs, CPU1 104*a*, the CPU2 104*b*, the CPU3 104*c*, . . . CPUn 104*n*.

According to the present invention, concurrently running a greater number of simulations typically leads to higher precision. The greatest number of simulations that can be concurrently run depends on available resources in the system, functions of the operating system, hardware architecture of the system, a necessary speed at which a simulation is performed, and other factors.

Simulator 204 in the present example simulates the flow of cars on a road and is expressed by a function F as follows:

$$x_{n+1}=x_n+\Delta t$$

$$y_{n+1}=F(x_n, y_n, \theta_i)$$

A simulation thread is run by repeatedly incrementing n by one, $n \rightarrow n+1$, in the equation until $x_n$ reaches a predetermined time.

In the above equation, $x_n$ represents a simulation time, and $\Delta t$ represents a time interval corresponding to one clock step. $y_n$ is typically a vector having a plurality of dimensions and represents the state of the simulation. $\theta i$ is a parameter of the simulator 204, which behaves differently when $\theta i$ differs. $\theta i$ is typically a vector formed of a plurality of elements. One of the elements of the parameter $\theta i$ can be a seed of random numbers used in simulator 204.

Simulator 204 records, during operation, the simulation time $T=x_n$ and a characteristic value S(T) of the calculation result $y_n$ in a predetermined area of the hard disk drive 116. Control module 202 can then acquire at an arbitrary point of time a result calculated by simulator 204 at a predetermined time. When the time at which a measured value is obtained is known in advance, the characteristic value S(T) of a calculation result $y_n$ only in the vicinity of that time can be recorded.

Control module 202 can stop or delete any activated simulation thread. This is a standard function of Win32API, Linux API, and APIs of other typical operating systems. Control module 202 can also activate as many simulators 204 as main memory 106 and other resources permit and concurrently run them as individual threads.

Parameters 210 for a simulation are saved in hard disk drive 116 and includes the parameter θi (i=1, . . . , k) to be given as an argument to simulator 204. The parameter θi (i=1, . . . , k) can be loaded in a predetermined area of main memory 106 when the system is activated so that control module 202 can readily refer to the parameter θi. Control module 202, when activating a plurality of simulators 204 as individual threads, can sequentially provide different θi (i=1, . . . , k) as a parameter argument so that simulations behave slightly differently from one another.

When control module 202 activates a plurality of simulators 204, and the number of available processors or cores is greater than the number of activated simulators 204, the control module 202 allocates the threads of the activated individual simulators 204 to the available processors or cores.

Weight calculation module 206, which is called by control module 202, has a function of calculating weight coefficients based on observed values and calculation results provided from activated simulators 204 for simulation relocation, which will be described later.

Simulator selection module 208, which is called by control module 202, has a function of producing k simulators 204, allowing repetition, based on the weight coefficients provided from weight calculation module 206 and the calculation results provided from activated simulators 204.

More detailed functions of weight calculation module 206 and simulator selection module 208 will be described later with reference to the flowcharts of FIG. 3 and the following figures.

Display module 212, which is controlled by control module 202, has a function of displaying an in-progress report of a simulation on display 114.

Data observation module 214, which is controlled by control module 202, has a function of acquiring observed data and the time at which the data was observed from observation apparatus 124 and allocating them in a predetermined area of main memory 106.

The modules shown in FIG. 2 can be created by using C, C++, C#, Java®, or any other known programming language as long as they are supported by the operating system and the system environment being used.

Figure 3:
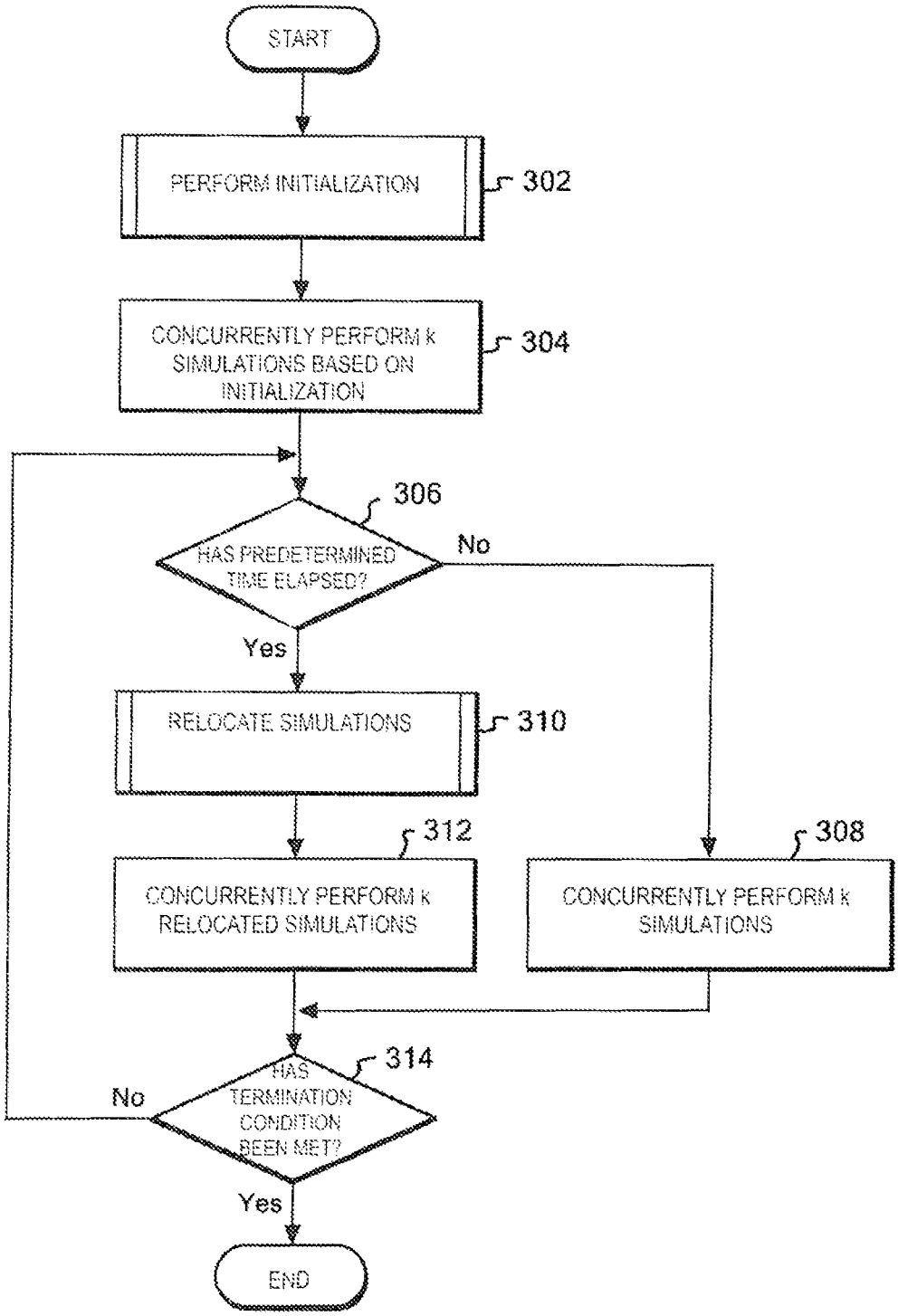
FIG. 3 shows a flowchart showing general processes in a simulation.

Referring to FIG. 3, step 302 provides control module 202 performing initialization before a simulation start.

Figure 4:
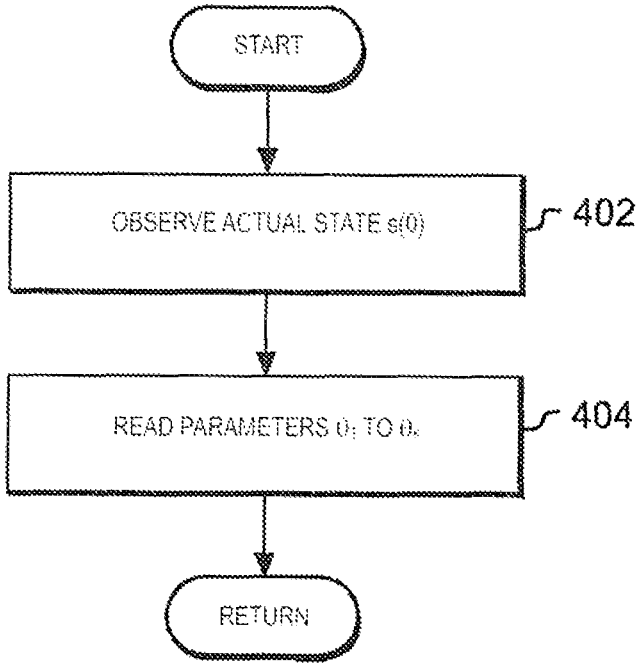
FIG. 4 shows a flowchart showing an initialization process.

The flowchart of FIG. 4 shows the initialization in more detail. In FIG. 4, the control module 202 uses in step 402 the function of the data observation module 214 to observe an actual state s(0), which corresponds to an observed value at time T=0. s(0) has the dimension and the state value corresponding to the result obtained by calculating the function F of the simulator 204. s(0) can be an observed value itself or a characteristic value calculated based on the observed value. In the present example, s(0) is assumed to be a characteristic value calculated based on an observed value.

In step 404, the control module 202 reads the parameter θi (i=1, . . . , k) from a predetermined area of the main memory 106 or the hard disk drive 116.

Referring back to FIG. 3 step 304, the control module 202 uses the observed initial value and the parameter θi (i=1, . . . , k) to run k simulations concurrently as follows: In the following equations, it is assumed that $y^{(i)}_0=s(0)$ (i=1, . . . , k)

$$X_{n+1}^{(1)} = x_n^{(1)} + \Delta t$$
$$y_{n+1}^{(1)} = F(x_n^{(1)}, y_n^{(1)}, \theta_1)$$

---

$$X_{n+1}^{(2)} = x_n^{(2)} + \Delta t$$
$$y_{n+1}^{(2)} = F(x_n^{(2)}, y_n^{(2)}, \theta_2)$$

---

$$X_{n+1}^{(3)} = x_n^{(3)} + \Delta t$$
$$y_{n+1}^{(3)} = F(x_n^{(3)}, y_n^{(3)}, \theta_3)$$

---

...

...

---

$$X_{n+1}^{(k)} = x_n^{(k)} + \Delta t$$
$$y_{n+1}^{(k)} = F(x_n^{(k)}, y_n^{(k)}, \theta_k)$$

In step 306, the control module 202 determines whether a predetermined time ($T_0$, for example) has elapsed. When the determination is no, performing concurrently the k simulations is continued in step 308.

When it is determined in step 306 that the predetermined time has elapsed, simulation relocation is performed in step 310. In step 312, the k relocated simulations are performed concurrently. The relocation in step 310 will be described later in more detail with reference to the flowchart of FIG. 5.

The determination in step 306 is made, for example, in response to actions of decrementing a value set to a predetermined variable as a counter and detecting that the value reaches zero. After the simulation relocation, the process of setting a value to the predetermined variable as a counter and decrementing the value is resumed. The simulation relocation is performed as described above at predetermined times.

In the determination in step 306, there can be a case where the data observation module has obtained no measured value for some reasons even after the predetermined time has elapsed. In this case, the determination in step 306 can not be immediately reflected even after the predetermined time has elapsed but can be reflected later after the measured value is updated.

In step 314, the control module 202 determines whether a termination condition has been met. The termination condition is, for example, whether a predetermined time has elapsed since the simulation started or whether an observation result becomes a predetermined value.

Alternatively, when an observation result is obtained regularly to some extent, the determination in step 306 can not be made after the predetermined time has elapsed but can be made when an observation result arrives.

Figure 5:
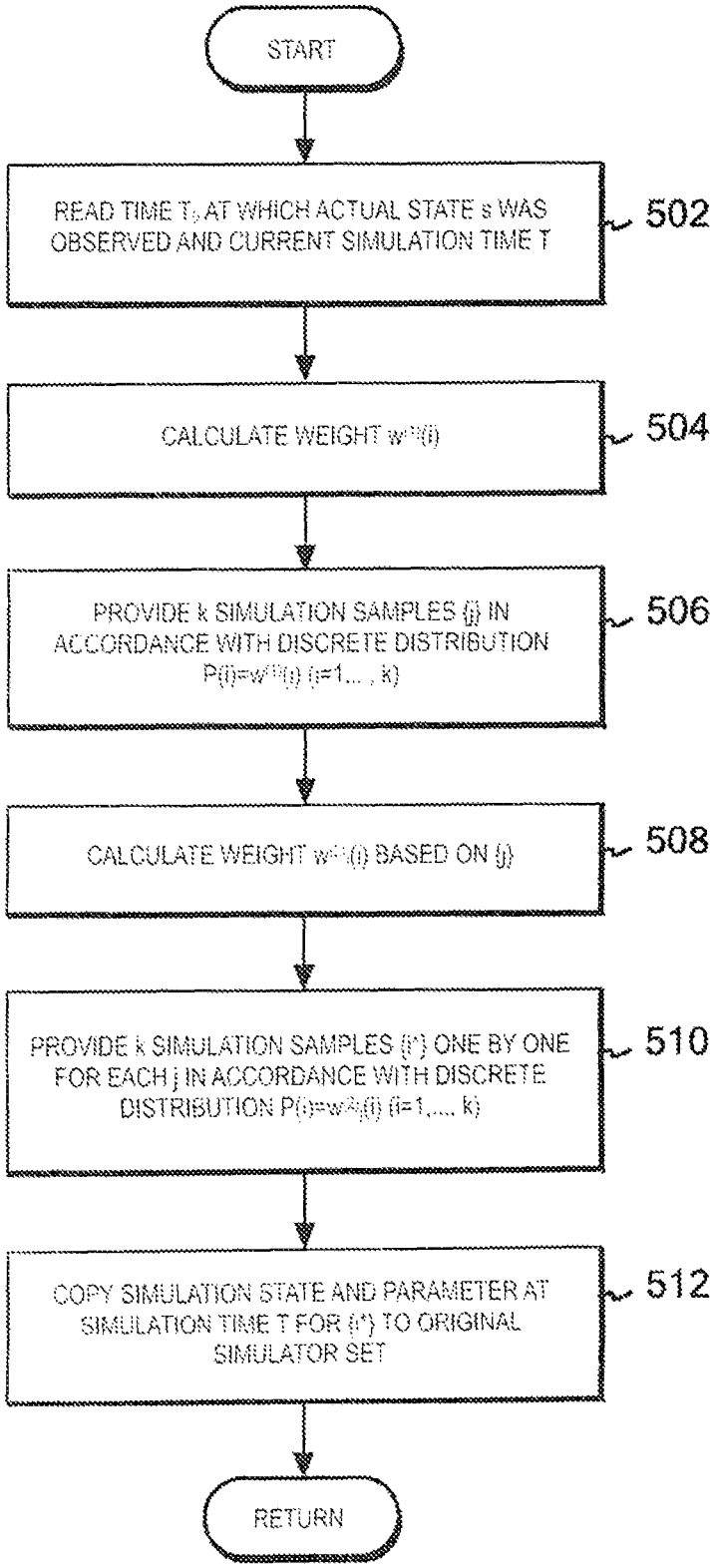
FIG. 5 shows a flowchart showing simulation relocation.

The relocation in step 310 will next be described in more detail with reference to the flowchart of FIG. 5.

In step 502, the control module 202 reads the time $T_0$ at which an actual state s was observed and the current simulation time T. The time $T_0$ at which the actual state s was observed can be read because the data observation module 214 stores an observed value and the time at which the observed value was observed in a predetermined storage area on the memory. The simulation time T can be read based on the simulation clock. Since a simulation is performed at a higher speed than in the real world, T is greater than $T_0$.

In step 504, the control module 202 calls the weight calculation module 206 to calculate weight $w^{(1)}(i)$ for i=1, . . . , k by using the following equation:

That is, let $S1(T_0)$, $S2(T_0)$, . . . , $Sk(T_0)$ be the values of the k simulations at the time $T_0$. $Si(T_0)$ is equal to $y^{(i)}_n$ in the equation described above. $T_0$ corresponds to the number of steps n.

Further, let $s(T_0)$ be the characteristic value of the measured value at the time $T_0$. That is, a simulation calculation result corresponds to the characteristic value. $w^{(1)}(i)$ is so selected based on a defined distance function d1 that $w^{(1)}(i)$ decreases as $d1(Si(T_0), s(T_0))$ increases. For example, d1 can be, but not limited to, a Euclidean distance when $Si(T_0)$ and $s(T_0)$ are vectors. Alternatively, d1 can be a Manhattan distance depending on the application in which $w^{(1)}(i)$ is used. Alternatively, for example, $w^{(1)}(i)$ can be, but not necessarily, so selected that the following relationship is satisfied: $w^{(1)}(i) \sim \exp(-d1(Si(T_0), s(T_0)))$. $w^{(1)}(i)$ is expressed by a monotonically decreasing function of the distance between a measured value and a simulated value.

Thereafter, $w^{(1)}(i)$ is scaled as follows:

$$\sum_{i=1}^{k} w^{(1)}(i) = 1 \qquad \text{[Equation 1]}$$

The weights $w^{(1)}(i)$ are so distributed that a simulation having a state value close to a measured value is likely selected.

In step 506, the control module 202 calls the simulator selection module 208, which provides k simulation samples {j} in accordance with a discrete distribution $P(i)=w^{(1)}(i)$ (i=1, . . . , k). Detailed processes performed by the simulator selection module 208 will be described later with reference to the flowchart of FIG. 6.

For each element j of the k simulation samples {j} produced in step 506, the control module 202 selects $w^{(2)}_j(i)$ in step 508 based on a defined distance function d2 in such a way that $w^{(2)}_j(i)$ decreases as $d2((Si(T), \theta i), (Sj(T), \theta j))$ increases. For example, d2 can be, but not limited to, a Euclidean distance when $(Si(T), \theta i)$ and $(Sj(T), \theta j)$ are vectors. The expression of d2 can be the same as that of d1 or differ therefrom. Further, the notation $(Si(T), \theta i)$ is a vector and means that a vector Si(T) and a vector θi are written side by side. As described above, since Si(T) represents the characteristic value, the parameter θi can also be taken as a kind of characteristic value. For example, $w^{(2)}_j(i)$ can be, but not necessarily, so selected that the following relationship is satisfied: $w^{(2)}_j(i) \sim \exp(-d2((Si(T), \theta i), (Sj(T), \theta j)))$. $w^{(2)}_j(i)$ is expressed by a monotonically decreasing function of the distance between the pair of the simulated value and the parameter from simulation sample i and the corresponding pair from simulation sample j.

Thereafter, $w^{(2)}_j(i)$ is scaled as follows:

$$\sum_{i=1}^{k} w_j^{(2)}(i) = 1 \qquad \text{[Equation 2]}$$

The weight $w^{(2)}_j(i)$ represents transition likelihood from a simulation j to a simulation i.

In step 510, the control module 202 calls the simulator selection module 208, which provides k simulation samples {i*} in accordance with a discrete distribution $P_j(i)=w^{(2)}_j(i)$ (i=1, . . . , k). That is, in this step, the simulator selection module 208 is called for each j, and simulation samples are selected one by one in accordance with the discrete distribution $P_j(i)=w^{(2)}_j(i)$ (i=1, . . . , k). When j starting from 1 reaches k, k simulation samples {i*} have been selected.

In step 512, the control module 202 sequentially copies a simulation state Si*(T) at the simulation time T and a parameter $\theta_{i*}$ for {i*} to the original simulator set so that the k simulation samples {i*} produced in step 510 form a new simulator set.

```
for (i = 1 ; i <= k; i++) {
Si(T) = Si*(T);
θi = θi*;
}
```

It is noted that the parameter $\theta_{i*}$ is in fact selected from $\theta_i$ (i=1, . . . , k).

Figure 6:
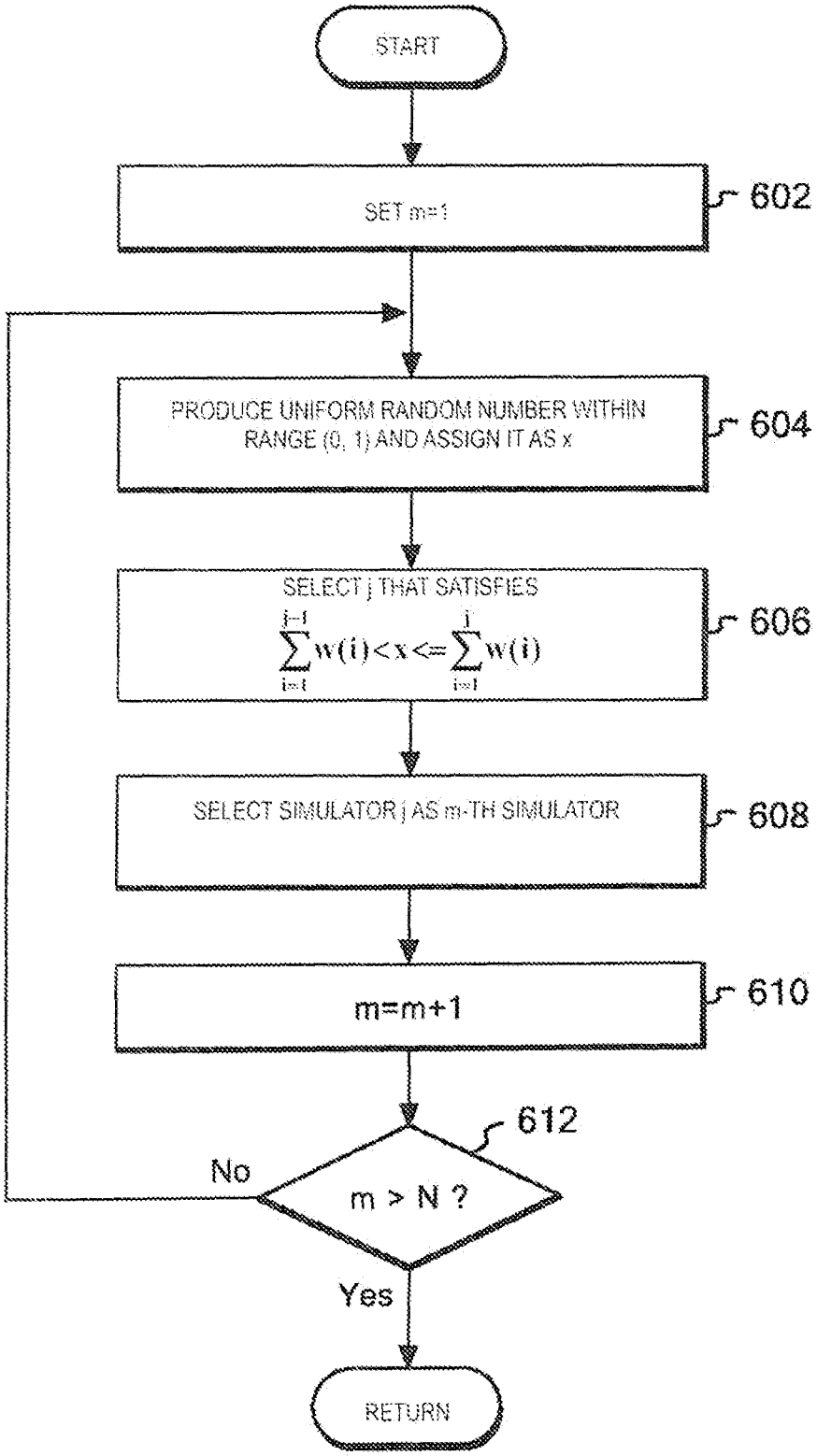
FIG. 6 shows a flowchart showing a process of producing a plurality of simulation samples in accordance with a discrete distribution.

Processes performed by the simulator selection module 208 will next be described with reference to the flowchart of FIG. 6. In the processes, the discrete distribution P(i)=w(i) (i=1, . . . , k) and the number N of simulators to be selected are used as arguments.

In step 602, the simulator selection module 208 sets a local variable m at one.

In step 604, the simulator selection module 208 uses a known algorithm to produce a uniform random number within a range (0, 1) and assigns it as x.

In step 606, the simulator selection module 208 selects j that satisfies the following equation:

$$\sum_{i=1}^{j-1} w(i) < x <= \sum_{i=1}^{j} w(i), \qquad \text{[Equation 3]}$$

Where $$\sum_{i=1}^{0} w(i) = 0 \qquad \text{[Equation 4]}$$

Since j is determined as described above, a simulator j is selected as an m-th simulator in step 608. In other words, the m-th simulator uses θj as a parameter.

In step 610, m is incremented by one, and in step 612, it is determined whether m is greater than N. When the determination is no, the simulator selection module 208 returns to step 604. When the determination is yes, it means that a predetermined number of simulators have been selected. The processes are therefore terminated, and the simulator selection module 208 returns to the point where it was called.

It should be understood that in step 608, the nature of a random number x can cause the same simulator to be selected repetitively in some cases.

Figure 7:
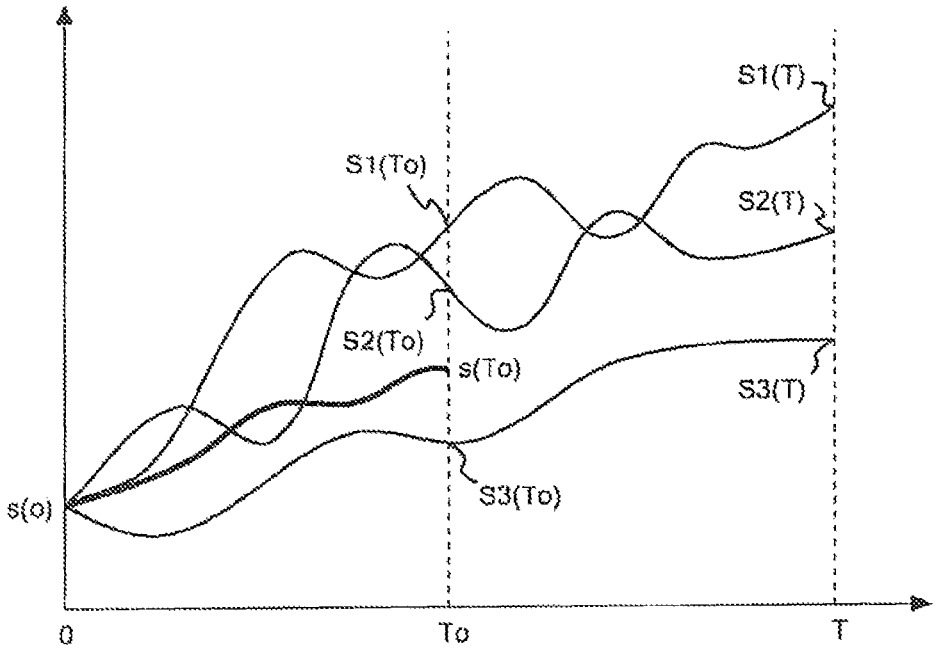
FIGS. 7 and 8 show diagrams on how simulations are performed.

FIG. 7 diagrammatically shows the behavior of a simulator in the present example. In FIG. 7, the vertical axis represents the state value of a simulation, and the horizontal axis represents time. It is assumed that the number of simulators that concurrently run is only three for ease of description.

FIG. 7 shows that when a measured value is obtained at $t=T_0$, the simulation time has reached time T later than $T_0$. In this case, the control proceeds from step 306 to step 310 shown in FIG. 3, where the simulation relocation is performed.

In the simulation relocation according to the present invention, the weight $w^{(1)}(i)$ is calculated in step 504 in accordance with the distance between the measured value at $t=T_0$ and the corresponding simulated value.

In step 506, the simulator selection module 208 is called, and k simulation samples are selected in accordance with the weight $w^{(1)}(i)$.

In step 508, the weight $w^{(2)}_j(i)$ is calculated based on the thus selected simulation samples. Based on the weight $w^{(2)}_j(i)$, the simulator selection module 208 is called for each j, and k simulation samples are selected anew.

In step 512, the state values and the parameters of the k simulation samples are copied as arguments for the original simulator set, and in step 312, the resultant relocated simulations are performed.

Figure 8:
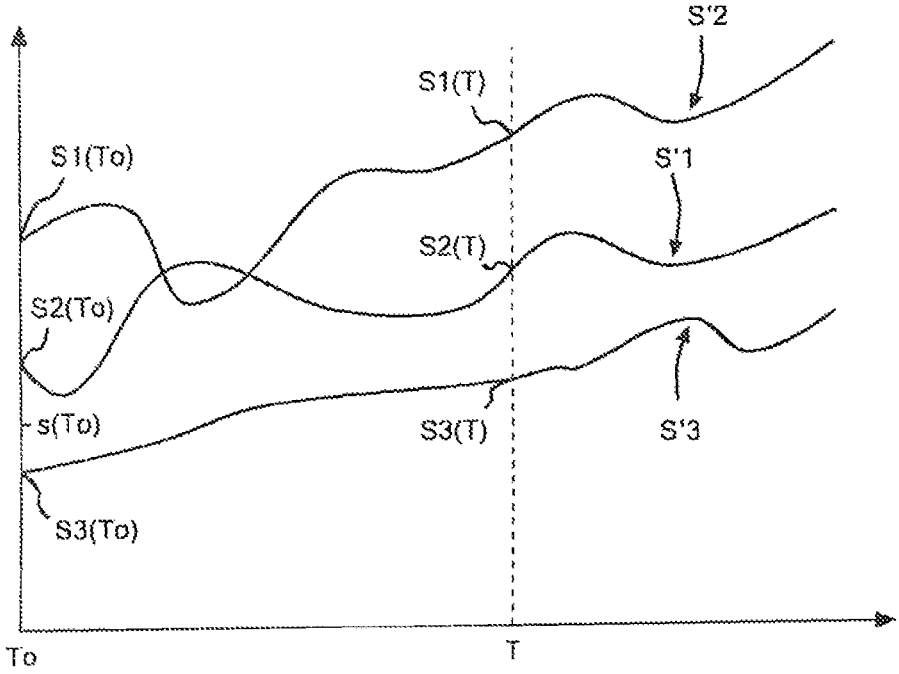

FIG. 8 shows that the resultant selected simulators S'1, S'2, and S'3 started at the simulation time T and are being performed.

The display module 212 displays the behavior of each of the simulations on the display 114.

When a plurality of simulation threads run, results obtained by averaging the state values thereof can be taken as a final simulation result.

In the example described above, $w^{(1)}(i)$ as a first weight coefficient and $w^{(2)}_j(i)$ as a second weight coefficient are used to produce a discrete distribution for selecting simulation samples. The example described above is preferred in terms of precision, but it should be understood that simulations can be performed even by producing a discrete distribution for selecting the simulation samples only by using the first weight coefficient. In this case, when a produced j-th simulation corresponds to an original i-th simulation, the calculation result and the parameter of the original i-th simulation are copied to the produced j-th simulation.

Through the above description of specific embodiments, it can be understood by those skilled in the art that the system, means and method as described above can be implemented by using computer executable instructions and/or being contained in processor control codes, for example, such codes are provided on an carrier medium such as a disk, CD or DVD-ROM, an programmable memory such as a read-only memory (firmware), or a data carrier such as a optical or electronic signal carrier. The means, server and its unit can be implemented by a hardware circuit of a super large-scale integrated circuit or gate array, a semiconductor such as a logic chip, transistor and so on, or a programmable hardware device such as a field programmable gate array, programmable logic device and so on, or by software executed by a variety of processors, or by a combination of above hardware circuit and software.

Although detailed description of the system and method for identifying advertisements in a web page according to the invention has been made in combination with the above specific embodiments, the present invention is not limited thereto. Various variations, alternations and modifications to the invention can be made by those skilled in the art under teachings of the specification without departing from the scope and principle of the invention. It should be understood that all such variations, alternations and modifications still fall into the protection scope of the invention which is defined by the attached claims.

What is claimed is:

1. A method for performing simulations through computer processes, the method comprising the steps of:

observing measured values of an event to provide observed values, wherein said step of observing starts at a predetermined observation time;

concurrently running a first plurality of simulations, wherein said first plurality of simulations have behaviors that are characterized by different parameters and start at said predetermined observation time;

producing a discrete distribution at a predetermined time after said predetermined observation time, wherein said discrete distribution is based on distances between said measured values at the predetermined time and a value of each of the first plurality of simulations at the predetermined time; and selecting a second plurality of simulations from the first plurality of simulations based on said discrete distribution, wherein a probability of selecting one of the first plurality of simulations decreases as the difference between the measured values at the predetermined time and the value of the one of the first plurality of simulations at the predetermined time increases, wherein the second plurality of simulations is a subset of the first plurality of simulations.

2. The method according to claim 1, wherein selecting a second plurality of simulations further comprises:

producing a transition likelihood when said second plurality of simulations are selected in accordance with said discrete distribution, wherein said selecting the second plurality of simulations produces at least another plurality of simulations based on said transition likelihood.

3. The method according to claim 1, wherein said predetermined time is a point of time when a predetermined period has elapsed since said predetermined observation time.

4. The method according to claim 1, wherein said predetermined time is a point of time when said measured values are obtained.

5. The method according to claim 1, wherein selecting a second plurality of simulations further comprises receiving calculation results and parameters from said second plurality of simulations.

6. The method according to claim 1, wherein said first plurality of simulations is a traffic simulation.

7. The method according to claim 1, wherein said measured values are probe car data or fixed-point observation data.

8. A non-transitory computer readable storage medium tangibly embodying a computer readable program code having computer readable instructions which when implemented, cause a computer to carry out the steps of a method comprising:

observing measured values of an event to provide observed values, wherein said step of observing starts at a predetermined observation time;

concurrently running a first plurality of simulations, wherein said first plurality of simulations have behaviors that are characterized by different parameters and start at said predetermined observation time;

producing a discrete distribution at a predetermined time after said predetermined observation time, wherein said discrete distribution is based on distances between said measured values at the predetermined timing and a value of each of the first plurality of simulations at the predetermined time; and selecting a second plurality of simulations from the first plurality of simulations based on said discrete distribution, wherein a probability of selecting one of the first plurality of simulations decreases as the difference between the measured values at the predetermined time and the value of the one of the first plurality of simulations at the predetermined time increases, wherein the second plurality of simulations is a subset of the first plurality of simulations.

9. The computer readable storage medium according to claim 8, wherein selecting the second plurality of simulations further comprises producing a transition likelihood when said second plurality of simulations are selected in accordance with said discrete distribution, wherein selecting the second plurality of simulations produces at least another plurality of simulations based on said transition likelihood.

10. The computer readable storage medium according to claim 8, wherein said predetermined time is a point of time when a predetermined period has elapsed since said predetermined observation time.

11. The computer readable storage medium according to claim 8, wherein said predetermined time is a point of time when said measured values are obtained.

12. The computer readable storage medium according to claim 8, selecting the second plurality of simulations further comprises receiving calculation results and parameters from said second plurality of simulations.

13. The computer readable storage medium according to claim 8, wherein said first plurality of simulations is a traffic simulation.

14. The computer readable storage medium according to claim 8, wherein said measured values are probe car data or fixed-point observation data.

15. A system for performing simulations, the system having a processor configured to perform a method comprising:

observing measured values of an event to provide observed values, wherein said observing starts at a predetermined observation time;

concurrently running a first plurality of simulations, wherein said first plurality of simulations have behaviors that are characterized by different parameters and start at said predetermined observation time;

producing a discrete distribution at a predetermined time after said predetermined observation time, wherein said discrete distribution is based on distances between said measured values at the predetermined timing and a value of each of the first plurality of simulations at the predetermined time; and selecting a second plurality of simulations from the first plurality of simulations based on said discrete distribution, wherein a probability of selecting one of the first plurality of simulations decreases as the difference between the measured values at the predetermined time and the value of the one of the first plurality of simulations at the predetermined time increases, wherein the second plurality of simulations is a subset of the first plurality of simulations.

16. The system according to claim 15, wherein the method further comprises:

producing a transition likelihood when said second plurality of simulations are produced in accordance with said discrete distribution, wherein at least another plurality of simulations are produced based on said transition likelihood.

17. The system according to claim 15, wherein said predetermined time is a point of time when a predetermined period has elapsed since said predetermined observation time.

18. The system according to claim 15, wherein said predetermined time is a point of time when said measured values are obtained.

19. The system according to claim 15, wherein the method further comprises:

receiving calculation results and parameters from said second plurality of simulations.

20. The system according to claim 15, wherein said first plurality of simulations is a traffic simulation.

21. The system according to claim 15, wherein said measured values are probe car data or fixed-point observation data.

* * * * *